US011286574B2

(12) United States Patent
Pfeffer et al.

(10) Patent No.: US 11,286,574 B2
(45) Date of Patent: Mar. 29, 2022

(54) CATHODE CURRENT COLLECTOR/CONNECTOR FOR A HALL-HEROULT CELL

(71) Applicants: Tokai COBEX GmbH, Wiesbaden (DE); Novalum SA, Venthône (CH)

(72) Inventors: Markus Pfeffer, Meitingen (DE); René Von Kaenel, Venthône (CH)

(73) Assignee: TOKAI COBEX GMBH, Wiesbaden (DE)

( * ) Notice: Subject to any disclaimer, the term of this patent is extended or adjusted under 35 U.S.C. 154(b) by 63 days.

(21) Appl. No.: 16/318,799

(22) PCT Filed: Jul. 26, 2017

(86) PCT No.: PCT/EP2017/068889
§ 371 (c)(1),
(2) Date: Jan. 18, 2019

(87) PCT Pub. No.: WO2018/019888
PCT Pub. Date: Feb. 1, 2018

(65) Prior Publication Data

US 2019/0284711 A1 Sep. 19, 2019

(30) Foreign Application Priority Data

Jul. 26, 2016 (DE) ..... 10 2016 213 715.8

(51) Int. Cl.
*C25C 7/00* (2006.01)
*C25C 3/16* (2006.01)
*C25C 3/08* (2006.01)

(52) U.S. Cl.
CPC . *C25C 3/16* (2013.01); *C25C 3/08* (2013.01)

(58) Field of Classification Search
CPC .. C25C 3/08; C25C 7/005; C25C 3/06; C25C 7/025; C25C 7/00; C25C 7/02
See application file for complete search history.

(56) References Cited

U.S. PATENT DOCUMENTS 3,390,071 A * 6/1968 McMinn ..... C25C 3/08 204/247.4
3,650,941 A 3/1972 Finnegan
(Continued)

FOREIGN PATENT DOCUMENTS

CA 2900418 A1 8/2014
CH 527909 A 9/1972
(Continued)

OTHER PUBLICATIONS

International Search Report and Written Opinion of the International Search Authority dated Dec. 11, 2017 of corresponding International application No. PCT/EP2017/068889; 10 pgs.
(Continued)

*Primary Examiner* — Zulmariam Mendez
(74) *Attorney, Agent, or Firm* — Maier & Maier, PLLC

(57) ABSTRACT

An electrolytic cell for the production of aluminium including collector bars under the cathode, namely a copper collector bar whose external terminal end is connected by a conductor element providing electrical connection of the collector bar to an external bus. This conductor element comprises a flexible connector strip of the same or a different highly conductive metal as the conductor bar, such as copper.

13 Claims, 4 Drawing Sheets

(56) References Cited

U.S. PATENT DOCUMENTS

| | | | |
|---|---|---|---|
| 3,736,244 | A | 5/1973 | Bohner |
| 4,359,377 | A | 11/1982 | Blanc et al. |
| 4,795,540 | A | 1/1989 | Townsend |
| 5,830,335 | A | 11/1998 | Antille |
| 5,976,333 | A | 11/1999 | Pate |
| 6,231,745 | B1 | 5/2001 | Homley et al. |
| 6,294,067 | B1 | 9/2001 | Gauthier et al. |
| 2006/0151333 | A1 | 7/2006 | Banek |
| 2017/0321338 | A1* | 11/2017 | Von Kaenel ..... C25C 7/025 |

FOREIGN PATENT DOCUMENTS

| | | | |
|---|---|---|---|
| EP | 0 204 647 | B1 | 1/1990 |
| EP | 2133446 | A1 | 12/2009 |
| SU | 1595345 | A3 | 9/1990 |
| WO | 200127353 | A1 | 4/2001 |
| WO | 200163014 | A1 | 8/2001 |
| WO | 200242525 | A1 | 5/2002 |
| WO | 2004031452 | A1 | 4/2004 |
| WO | 2005098093 | A2 | 10/2005 |
| WO | 2007118510 | A2 | 10/2007 |
| WO | 2008062318 | A2 | 5/2008 |
| WO | 2011148347 | A1 | 12/2011 |
| WO | 2012161594 | A1 | 11/2012 |
| WO | 2016/079605 | A1 | 5/2016 |
| WO | 2016079605 | A1 | 5/2016 |
| WO | 2016105204 | A1 | 6/2016 |

OTHER PUBLICATIONS

Ukrainian Office Action dated Aug. 18, 2021, in connection with corresponding UA Application No. a201901838 (10 pp., including machine-generated English translation).

* cited by examiner

CATHODE CURRENT COLLECTOR/CONNECTOR FOR A HALL-HEROULT CELL

FIELD

The invention relates to the production of aluminium using the Hall-Héroult process; in particular to the optimization of the cathode collector/connector bars for connecting the cell to an external bus.

BACKGROUND

Aluminium is produced by the Hall-Héroult process, by electrolysis of alumina dissolved in cryolite based electrolytes at temperature up to 1000° C. A typical Hall-Héroult cell is composed of a steel shell, an insulating lining of refractory materials and a carbon cathode holding the liquid metal. The cathode is composed of a number of cathode blocks in which collector bars are embedded at their bottom to extract the current flowing through the cell.

A number of patent publications have proposed different approaches for minimizing the voltage drop between the liquid metal to the end of the collector bars. WO2008/062318 proposes the use of a high conductive material in complement to the existing steel collector bar and gives reference to WO 02/42525, WO 01/63014, WO 01/27353, WO 2004/031452 and WO 2005/098093 that disclose solutions using copper inserts inside collector steel bars. U.S. Pat. No. 4,795,540 splits the cathode in sections as well as the collector bars. WO2001/27353 and WO2001/063014 use high conductive materials inside the collector bars. US2006/0151333 covers the use of different electrical conductivities in the collector bars. WO 2007/118510 proposes to increase the section of the collector bar when moving towards the center of the cell for changing the current distribution at the surface of the cathode. U.S. Pat. Nos. 5,976,333 and 6,231,745 present the use of a copper insert inside the steel collector bar. EP 2 133 446 A1 describes cathode block arrangements to modify the surface geometry of the cathode in order to stabilize the waves at the surface of the metal pad and hence to minimize the ACD (anode to cathode distance).

WO 2011/148347 describes a carbon cathode of an aluminium production cell that comprises highly electrically conductive inserts sealed in enclosures within the carbon cathode. These inserts alter the conductivity of the cathode body but do not participate in current collection and extraction by the collector bars.

The electrical conductivity of molten cryolite is very low, typically 220 $\Omega^{-1}$ $m^{-1}$ and the ACD cannot be decreased much due to the formation of magneto-hydrodynamic instabilities leading to waves at the metal-bath (metal—cryolite electrolyte) interface. The existence of waves leads to a loss of current efficiency of the process and does not allow decreasing the energy consumption under a critical value. On average in the aluminium industry, the current density is such that the voltage drop in the ACD is a minimum at 0.3 V/cm. As the ACD is 3 to 5 cm, the voltage drop in the ACD is typically 1.0 V to 1.5 V. The magnetic field inside the liquid metal is the result of the currents flowing in the external busbars and the internal currents. The internal local current density inside the liquid metal is mostly defined by the cathode geometry and its local electrical conductivity. The magnetic field and current density produce the Lorentz force field which itself generates the metal surface contour, the metal velocity field and defines the basic environment for the magneto-hydrodynamic cell stability. The cell stability can be expressed as the ability of lowering the ACD without generating unstable waves at the surface of the metal pad. The level of stability depends on the current density and induction magnetic fields but also on the shape of the liquid metal pool. The shape of the pool depends on the surface of the cathode and the ledge shape. The Prior Art solutions respond to a given level to the needed magneto-hydrodynamic status to satisfy good cell stability (low ACD) but the solutions using copper inserts are very expensive and often need sophisticated machining processes.

WO 2016/079605, the content of which is incorporated herein by way of reference, describes a highly electrically conductive connector bar that comprises a central part located under a central part of the carbon cathode, usually directly located into a cathode slot or through-hole or using a U-shaped profile as support, this central part of the highly electrically conductive connector bar having at least its upper outer surface in direct electrical contact with the carbon cathode or in contact with the carbon cathode through an electrically conductive interface formed by an electrically conductive glue and/or an electrically conductive flexible foil or sheet applied over the surface of the highly electrically conductive connector bar. The highly electrically conductive connector bar is selected from copper, aluminium, silver and alloys thereof, preferably copper or a copper alloy and comprises one or two outer parts located adjacent to and on one side or on both sides of the central part and a terminal end part or parts extending outwardly from said outer part(s). These terminal end part(s) of the highly electrically conductive collector bar is/are electrically connected in series each to a steel conductor bar of greater cross-sectional area than the highly electrically conductive connector bar, said steel conductor bar(s) extending outwardly for connection to an external current supply busbar.

In this known arrangement, the terminal end parts of the highly electrically conductive metal bar are preferably electrically connected in series to the steel conductor bar forming a transition joint wherein the highly electrically conductive metal bar and the steel conductor bar overlap one another partially and are secured together by welding, by electrically-conductive glue and/or by means for applying a mechanical pressure such as a clamp to achieve a press fit, or a joint secured by thermal expansion. Alternatively, the secured end parts are threaded together. The steel bars forming the transition joint extend outwardly for connection to a busbar network external of the cell, the outwardly-extending end sections of the steel bars having an increased cross-section to reduce voltage drop and assure thermal balance of the cell.

The known arrangement with steel bars forming a transition joint is partly satisfactory in than it produces an adequate heat loss for a small overvoltage penalty. However, the copper/steel contact is complicated and leads to increased manufacturing cost, whereas these copper/steel contacts are susceptible to degradation over time leading to poor contact.

SUMMARY

The main and first object of the invention is to simplify the collector bar system by using the copper bar (or copper bars) as one piece going from inside the carbon cathode directly outside the cell where it is connected at the position where a steel bar was formerly connected.

It is to be understood that according to the invention the term "carbon cathode" means all types of cathode based on anthracite and/or graphite and/or coke, regardless whether these cathodes are baked or graphitized, Another object is to realize a reduction in heat flux in the copper bar by reduction its section using different techniques.

Another object is to further simplify the connection by using a copper flex from the end of the copper bar to connect directly the main busbar.

Another aim of the invention is that the copper bars can go out of the cell without any intermediate steel element and can be directly connected to the flexes or to the busbars. In order to achieve the desired temperature at the connecting point (150° C. to 250° C.), the desired voltage drop from liquid metal to the connecting point (100 mV to 300 mV) and the desired heat flux (500 W to 1500 W) a reduction of cross section of the copper bars can be realized before the connecting point preferably outside the cell.

Thus the invention enables to dispense advantageously with the former steel connector bars, at lower cost, by providing connections that are reliable over the long term, reducing the heat flux and with a lower overvoltage penalty.

By way of explanation, the electrical current flows from the carbon cathode into the copper bar which must itself be connected to the external main busbars made of aluminium to lead the current to the next cell.

The objective is to minimize the voltage drop, meaning to realize the lowest technically feasible electrical resistance. This implies a large section for the collector bar itself. Copper from the cathode to the external busbar can perform adequately with a reasonable section due to the high electrical conductivity.

The amount of heat extracted from the cathode towards the outside of the cell should be as small as possible, because according to the first law of thermodynamics the heat produced is equal to heat loss at steady-state condition. In other words, if the section is too large, too much heat will leave the cell and, due to the low voltage, cryolite will freeze on the surface of the cathode which is not acceptable. Also, it is not possible to connect a copper bar with high temperature on the main aluminium busbar.

Previously it was believed that these constraints would impose to have a steel element in the form of a bar between the copper bars inside the cell to the external parts of the cell. Now it has been computed that we can use only a metal of high electrical conductivity such as copper for the connection to outside the cell, if we have a solution to cool the end of the copper bar and if we can regulate the amount of heat that must satisfy the cell requirements.

One solution to cool the end of the copper current collector bar is to use a copper or aluminium flex. Another solution to cool the end of the copper current collector bar is to adjust its section. Yet another solution to cool the end of the copper current collector bar is to fit a big aluminum block. These and other solutions are contemplated by the present invention alone or in combination.

The invention relates to a cathode current collector and connector assembly assembled in a carbon cathode of a Hall-Héroult cell for the production of aluminium, said assembly comprising at least one bar of a highly electrically conductive metal that is located under the carbon cathode. The highly-electrically conductive metal has an electrical conductivity greater than that of steel and is preferably of copper or a copper alloy. The or each highly electrically conductive collector bar comprises one or two terminal end part or parts extending outwardly up to inside or outside a cell outer cover, whereat said terminal end part(s) of the or each highly electrically conductive collector bar are electrically connected in series each to a conductor element providing connection to an external bus.

According to a main aspect of the invention, the conductor element that provides electrical connection of the collector bar to an external bus comprises a flexible connector strip of the same or a different highly conductive metal as the connector bar.

The highly electrically conductive metal is selected from copper, aluminium, silver and alloys thereof, preferably copper or a copper alloy.

Thus we can determine the right surface of copper flex to have natural convection cooling. The section defines the voltage drop and heat conduction (heat extracted from the cell), the surface of the flex determines the flex heat loss that is needed to decrease the temperature before reaching the main conductor that remains preferably under 100° C.-120° C.

The flexible connector strip is typically a flexible strip of copper or a copper alloy having at its ends connecting pieces of copper with rings or hooks for connection directly or indirectly to the terminal part of the collector bar and to an external bus. When such flexible connector is connected between the collector bar and the bus, it typically sags or flexes in its middle part.

The terminal part(s) of the collector bars advantageously comprise, in the vicinity of said connector, a zone of reduced cross-sectional area wherein the cross-sectional area of said zone of the terminal part is less than the cross-sectional area of the remainder of said terminal part(s).

The zone of reduced cross-sectional area typically comprises at least one opening, or recess or part of reduced thickness in the terminal end part of the collector bar.

The highly conductive (copper) bars can thus go out of the cell without any intermediate steel plate or bar and can be directly connected to flexed conductors or to the external busbars. The zone of reduced cross-section is provided before the connecting point and is preferably outside the cell. This zone of reduced cross-section reduces the section in the connecting area to minimize heat losses in such a way as to equilibrate the produced heat in the cathode. It thus provides a desired temperature of 150° C. to 250° C. at the connecting point, a desired voltage drop of 100 mV to 300 mV from the liquid metal to the connecting point and a desired heat flux of 500 W to 1500 W.

In some embodiments, the connector comprises a conductor block of the same or a different highly electrically conductive metal as the collector bar, wherein the conductor block is connected to the terminal end part of the collector bar(s) such that it protrudes from above and below and/or laterally from either side of said terminal end part.

In a particular embodiment, the collector bar comprises two spaced-apart arms joined at an external end by a cross-piece, wherein a conductor block is externally connected to the cross-piece, and wherein the two spaced-apart arms each comprise adjacent to the connection with the cross-piece, a said zone of reduced cross-sectional area wherein the cross-sectional area of each arm is less than the cross-sectional area of the remainder of said arms.

In this case, the conductor block can be connected to the flexible connector strip which is made of a plurality of strips or braids or embossed sections of highly conductive metal.

The mentioned conductor block can be made of aluminium, copper or alloys thereof, whereas the flexible connector strip is preferably made of copper or a copper alloy.

In preferred embodiments, the conductor block is attached to the terminal section of the collector bar(s) such that it protrudes from above and/or below and/or laterally from either side of said terminal section.

Preferably, also, a bimetallic plate is provided between facing surfaces of the conductor block and the collector bar. One side of the bimetallic plate in contact with the collector bar is preferably made of the same metal as the collector bar, for example copper. The other side of the bimetallic plate in contact with the conductor block is preferably made of the same metal as the conductor block, for example aluminium. This bimetallic plate can occupy only the space between the facing surfaces, or it may extend partly or completely over the free surface of the conductor block.

In some embodiments, terminal part(s) of the collector bars comprise an outer protective casing, preferably of steel, extending up to the vicinity of said connector. This protective casing will typically stop short of the mentioned zone of reduced cross-section, where provided, or short of the mentioned cross-bar, where provided. The space between the collector bar and the protective casing is optionally filled with a material of low electrical conductivity, for example a material based on ceramics or amorphous carbon, preferably ceramic materials. This amorphous carbon can be coke or anthracite. The ceramic material can be ceramic fiber sheets, ceramic fiber wool or granules.

In all embodiments, at least one cathode is composed of carbon in a proportion of at least 50% by weight, preferably in a proportion of at least 60% by weight, more preferably in a proportion of at least 80% by weight, even more preferably in a proportion of at least 90% by weight and most preferably in a proportion of at least 95% by weight of carbon.

In another embodiment, an upper part of the cathode, typically its upper surface, may contain at least one refractory hard metal compound like TiB2 and a lower part of the cathode is made of carbon and/or graphite, for example amorphous carbon in particular containing anthracite.

The cathode current collector and connector assembly according to the invention can incorporate all of the features described in WO 2016/079605. For example, the copper current collector will usually directly contact the carbon block of the cathode. In particular, the new invention can incorporate for example the following features from WO 2016/079605.

The surface of the upper part and optionally the sides of the highly electrically conductive metal can be roughened or provided with recesses such as grooves or projections such as fins to enhance contact with the carbon cathode.

When there is a conductive interface between the highly electrically conductive metal and the carbon cathode, such conductive interface can be selected from a metal cloth, mesh or foam, preferably of copper, a copper alloy, nickel or a nickel alloy, or a graphite foil or fabric, or a conductive layer of glue, or a combination thereof. Advantageously the conductive interface comprises a carbon-based electrically conductive glue obtainable by mixing a solid carbon-containing component with a liquid component of a 2-component hardenable glue.

Depending on the cell design, the sides and optionally the bottom of the highly electrically conductive metal bar can directly or indirectly contact ramming paste or refractory bricks in contact with the carbon cathode.

The highly electrically conductive metal bar can be machined with at least one slot or provided with another space, the slot or space being arranged to compensate for thermal expansion of the bar in the cathode by allowing inward expansion of the highly electrically conductive metal into the space provided by the slot(s).

The cathode carbon can electrically contact the open upper outer surface of the highly electrically conductive metal as a result of the weight of the cathode on the highly electrically conductive metal, and by controlled thermal expansion of the highly electrically conductive metal.

Outer part(s) of the highly electrically conductive connector bar typically extend under or through an electrically conductive part of the cell bottom, in which case these outer parts of the highly electrically conductive connector bar are electrically insulated from the electrically conductive part of the cell bottom, in particular from side parts of the carbon cathode or ramming paste. Some sections of the highly electrically conductive metal bar are conveniently insulated from the electrically conductive part of the cell bottom by being encased in an insulator, in particular by being encased in one or more sheets of insulating material such as alumina wrapped around said outer part(s) or in a layer of electrically insulating glue or cement or any insulating material capable to withstand up to 1200° C.

The bar of the highly electrically conductive metal in the central section of the cathode current collector can be held in a U-shaped profile made of a material that retains its strength at the temperatures in a Hall-Héroult cell cathode. Such U-shaped profile can have a bottom under said bar and on which the bar rests, optionally at least one upstanding fin, and side sections that extend on the sides and are spaced apart from or contact the sides of the highly conductive bar. Said highly conductive bar has at least an upper part and optionally also side parts left free by the U-shaped profile to enable the highly electrically conductive metal to contact the carbon cathode directly or via a conductive interface. The open upper part and preferably also the sides of the highly electrically conductive metal make contact with the carbon cathode directly or via a conductive interface. The U-shaped profile is typically made of a metal such as steel, or of concrete or a ceramic.

Using cathode current collector bars according to WO 2016/079605, increases the conductivity of the carbon cathode enabling the useful height of the cathode block to be increased by from 10% to 30% depending on the original cathode design and the design of the upper contact profile of the highly conductive metal of the new collector bar. By increasing the height of the cathode block, the useful lifetime of the cathode and hence the cell can be increased accordingly.

Using cathode current collector bars according to WO 2016/079605 also leads to an optimized current distribution in the liquid metal and/or inside the carbon cathode allowing for operating the cell at lower voltage. The lower voltage results from either a lower anode to cathode distance (ACD), and/or to lower voltage drop inside the carbon cathode from liquid metal to the end of the collector bar.

Control of thermal expansion relative to the carbon cathode can be achieved by machining one or more slots into the highly conductive bar or by using two or more spaced bars.

BRIEF DESCRIPTION OF THE DRAWINGS

The invention will be further described by way of example with reference to the accompanying drawings, in which.

DETAILED DESCRIPTION

Figure 1A:
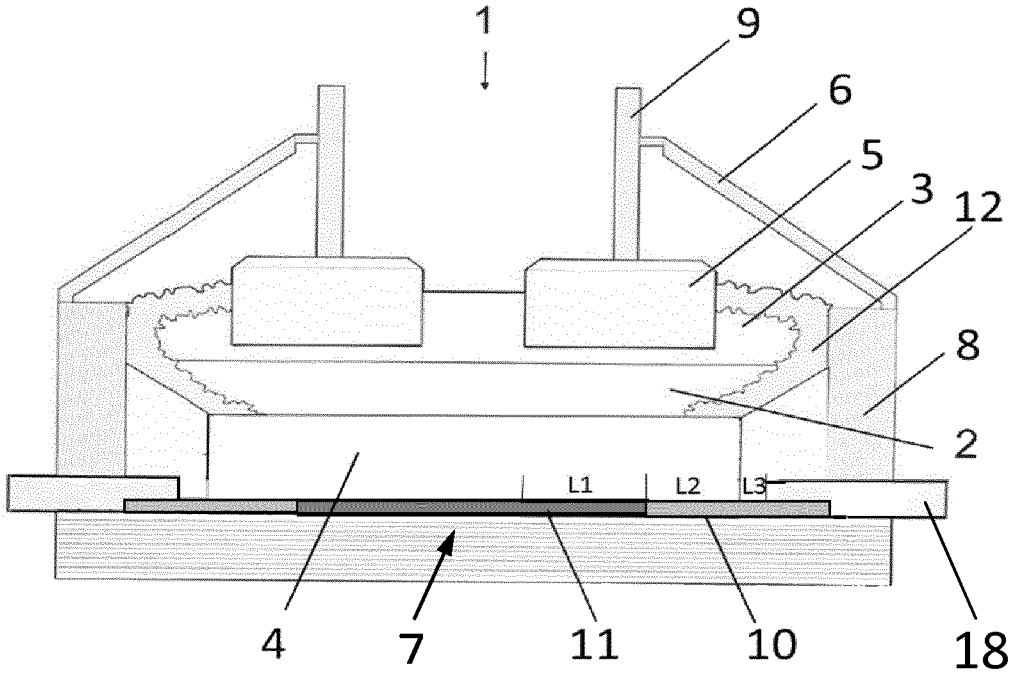
Figure 1A Prior art
FIG. 1A is a schematic cross-section through a Hall-Héroult cell equipped with a prior art collector and connector bar arrangement.

FIG. 1 schematically shows a Hall-Heroult aluminium-production cell 1 according to WO 2016/079605 comprising a carbon cathode cell bottom 4, a pool 2 of liquid cathodic aluminium on the carbon cathode cell bottom 4, a fluoride—i.e. cryolite-based molten electrolyte 3, containing dissolved alumina on top of the aluminium pool 2, and a plurality of anodes 5 suspended in the electrolyte 3. Also shown is the cell cover 6, cathode current collector bars 7 according to the invention that lead into the carbon cell bottom 4 from outside the cell container 8 and anode suspension rods 9. As can be seen, the collector bar 7 is divided in zones. Zone 10 is insulated electrically and zone 11 is composed of layers. Molten electrolyte 3 is contained in a crust 12 of frozen electrolyte.

An essential consideration of WO 2016/079605 was that steel bars 18 of enlarged cross-sectional area were connected in electrical series to the ends of the collector bars 7 and protrude outside the cell 1 for connection to external current supplies. Zone 10 of the collector bar is for example electrically insulated by being wrapped in a sheet of alumina or by being encased in electrically insulating glue or cement.

Figure 1B:
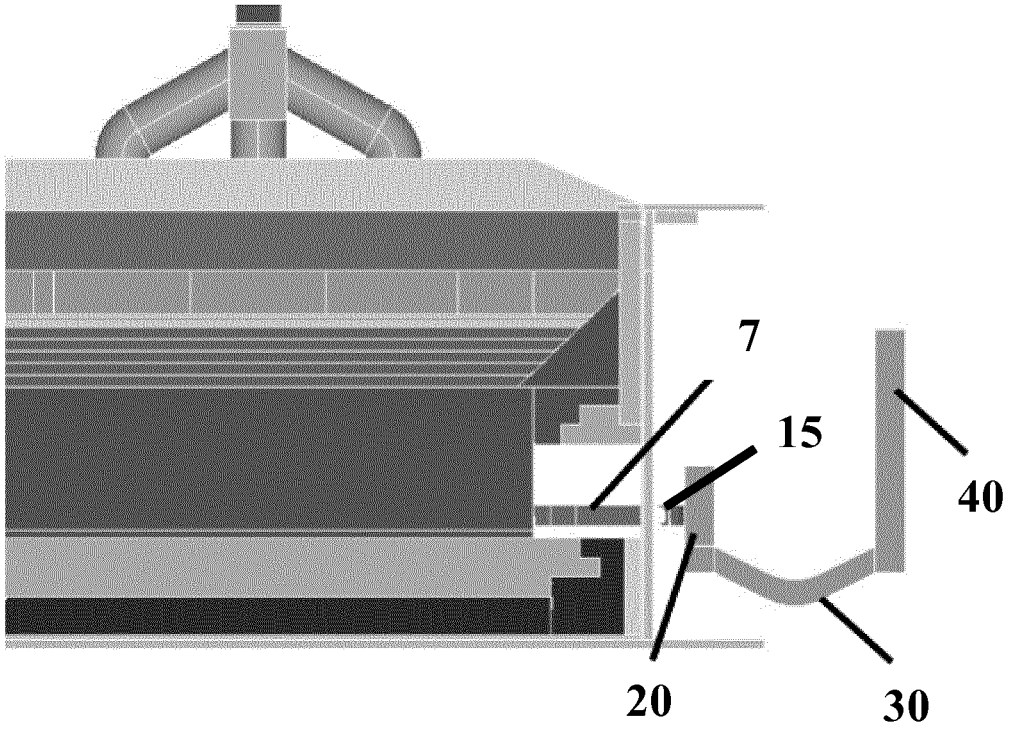
FIG. 1B is a schematic view of a Hall-Héroult cell equipped with a collector and connector bar arrangement according to the invention.

FIG. 1B schematically shows a Hall-Héroult cell equipped with a collector and connector bar arrangement according to the invention. Here, a copper collector bar 7 is connected directly to the main busbar 40 via an intermediate aluminium block 20 and a flexible copper connector 30.

Figure 2:
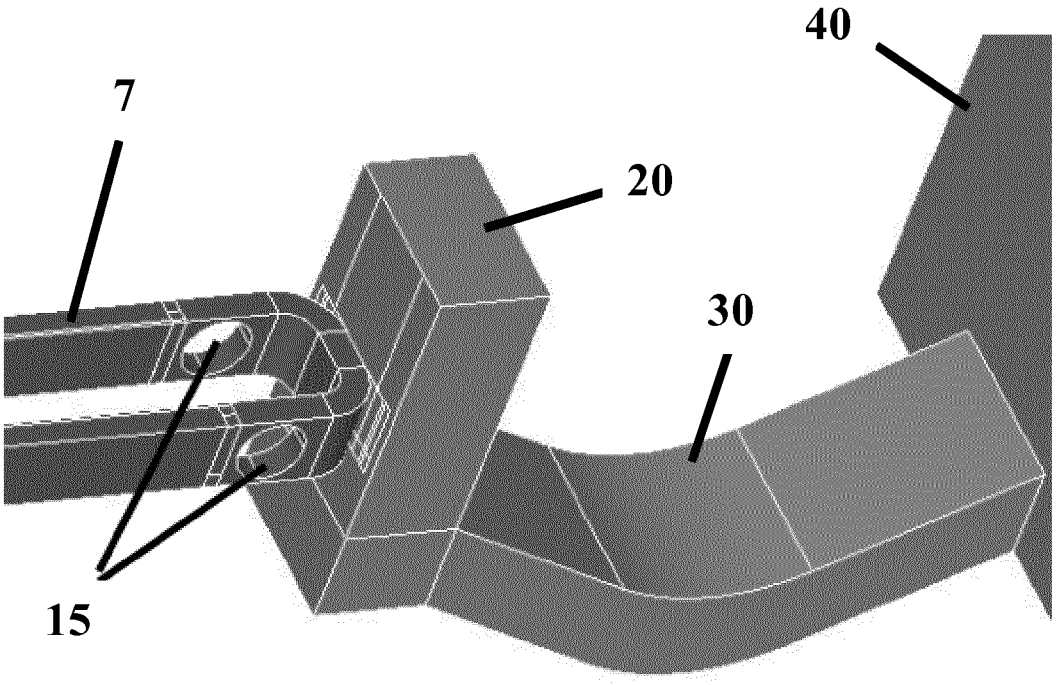
FIG. 2 is a schematic perspective view showing the connection of a copper collector bar to an external busbar.

FIG. 2 is an enlarged scale perspective view showing an example of the connection of the copper collector bar 7 to the external busbar 40. As shown, in this example, the collector bar 7 comprises two parallel spaced-apart arms joined at an external end by a cross-piece. The aluminium conductor block 20, which is wider than and much higher than the spaced-apart arms 7, is externally connected to the cross-piece. The two spaced-apart arms each comprise adjacent to the connection with the cross-piece, a zone 15 wherein the cross-sectional area of each arm is less than the cross-sectional area of the remainder of said arms, in this example by having circular holes in the opposite arms, adjacent to the connection area.

The aluminium conductor block 20 is massive compared to the collector bars 7 and is attached to the cross-piece of the collector bar(s) such that it protrudes from above and below the terminal section of the collector bars 7 and laterally from either side. As shown, the protruding bottom part of the conductor block 20, opposite the collector bars 7, is connected by a flexible copper connector 30 connected at its other end to the busbar 40, this flexible connector 30 sagging in the middle.

The conductor block 20 when made of aluminium can for example typically measure 220×120×50 mm but this block 20 can be dispensed with when using a copper flex.

Figure 3:
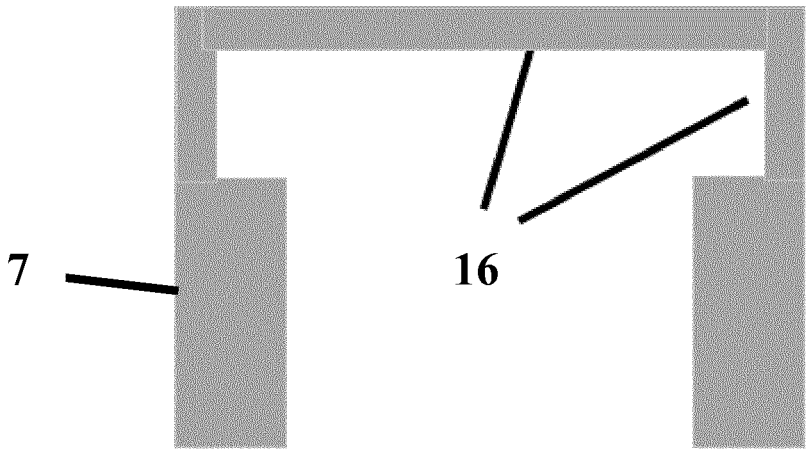
FIG. 3 is a diagrammatic view showing one possibility of providing a zone of reduced cross-section in a collector bar.

FIG. 3 is a diagrammatic view showing one possibility of providing a zone 16 of reduced cross-section in a collector bar, namely by reducing the thickness along and adjacent to the cross-piece.

Figure 4:
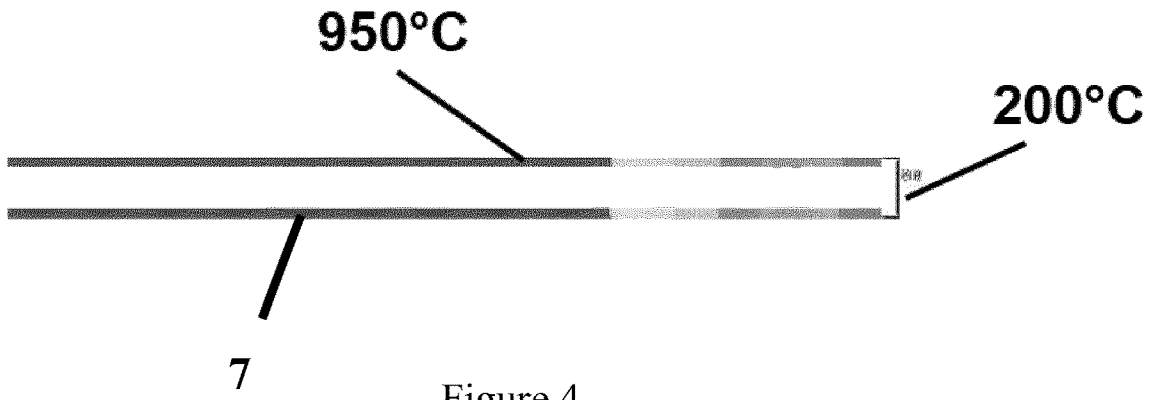
FIG. 4 illustrates the temperature decrease at the end of the collector bar.

FIG. 4 illustrates the temperature decrease at the end of the collector bar. The temperature is typically close to 950° C. inside the carbon cathode and decreases when leaving the cathode to reach about 200° at the copper-bar/flex interface.

Figure 5:
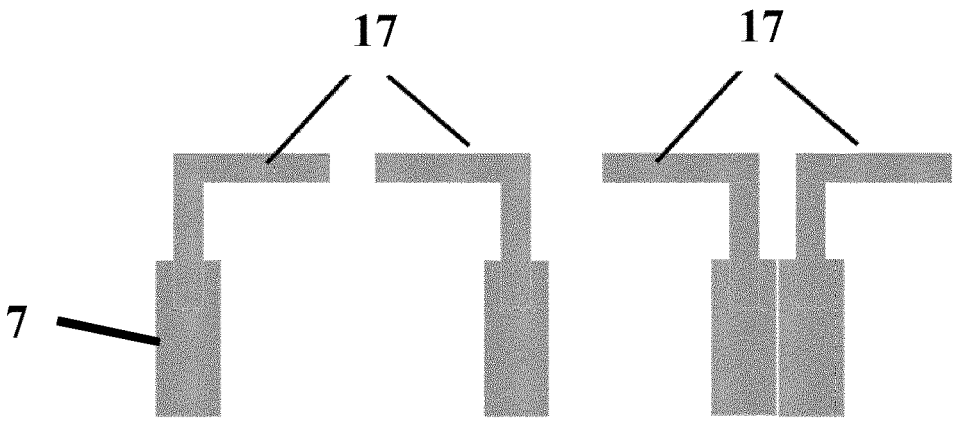
FIG. 5 shows bent bars with reduced section and connecting area.

FIG. 5 shows bent bars 7 with reduced section in the connecting area 17. The bent areas are used to bolt the end of the copper bar to the copper flex(es) and/or to the solid interface 20.

Figure 6:
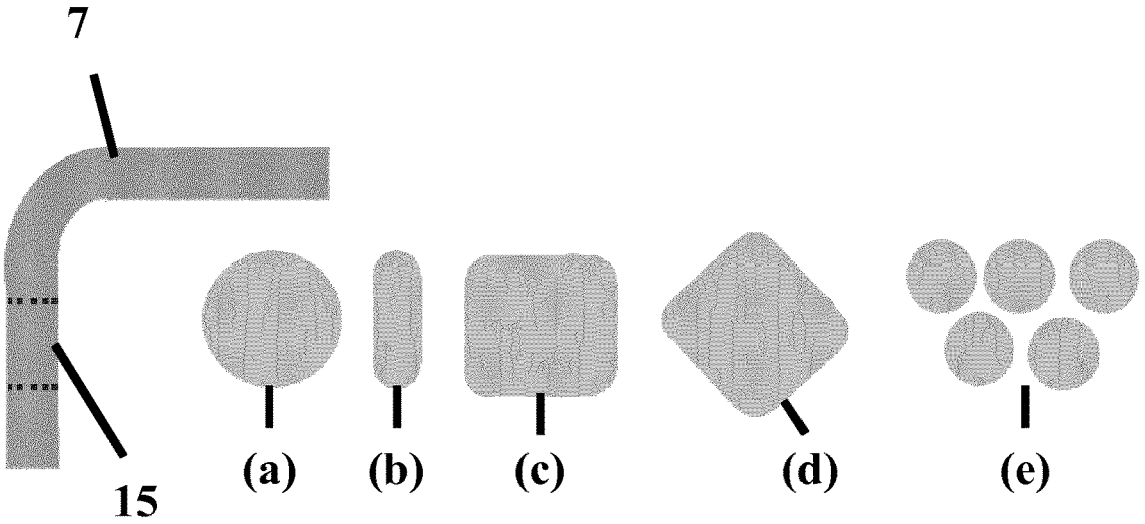
FIG. 6 shows examples of holes of different shapes to decrease the cross-section of the collector bar.

FIG. 6 shows examples of holes of different shapes to decrease the cross-section of the collector bar 7 in a zone 15. FIG. 6*a* shows a circular or optionally oval opening. FIG. 6*b* shows an opening of narrow rectangular shape rounded at its edges. 6*c* shows a square opening with rounded edges and 6*d* a lozenge shape with rounded edges. FIG. 6*e* shows an array of five round openings grouped together.

Figure 7:
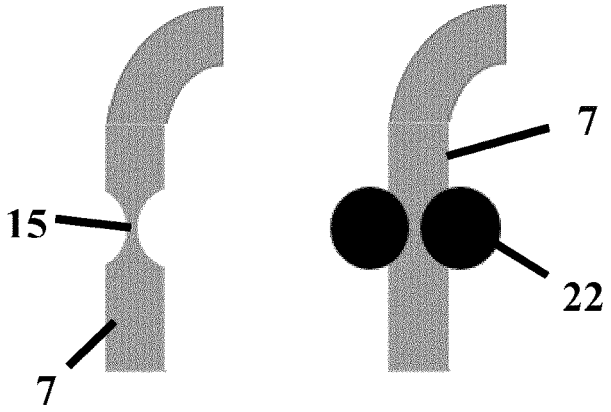
FIG. 7 illustrates another way of reducing the cross-section of a collector bar.

FIG. 7 illustrates another way of reducing the cross-section of a collector bar 7 by compression between two rollers 22 to form a zone 15 of reduced cross-section shaped by the rollers.

Figure 8:
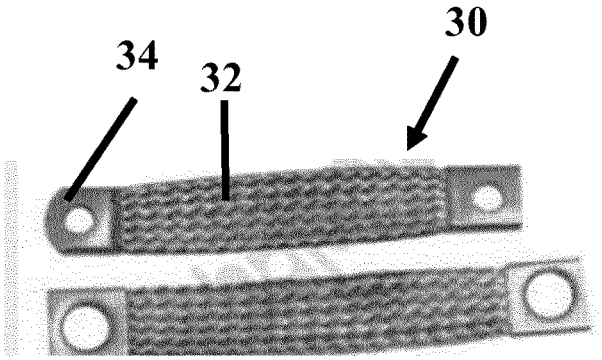
FIG. 8 shows two examples of flexible copper strips.

FIG. 8 shows two examples of flexible copper strips 30 for joining the block 20 to the external bus 40. Each flexible strip 30 is made up of an indented or ribbed or braided copper strip 32 having at either end a solid copper connector 34 for connection to the block 20 or the bus 40. The connectors 34 have a central circular opening for making the connection, so one end of the copper bar 7 can be bolted to one end of the flexible strip 30 or to the underside of a block 20, and the other end of the flexible strip 30 can be clamped to the main busbar 40.

In order to realize a very low contact voltage over time, a special electrically-conductive metallic foam such as ECOCONTACT™ can be used at the copper-aluminium contact (30/20) and at the copper-copper contact (30/40).

These copper flexible strips 30 can advantageously be used to replace current aluminium flexes. The advantages of copper flexes when compared to the aluminium flexes are numerous:

Fast implementation

Highly flexible easing the procedure

Lower voltage drop

Easy to find the right section

No mechanical stress on the copper bar.

Figure 9A:
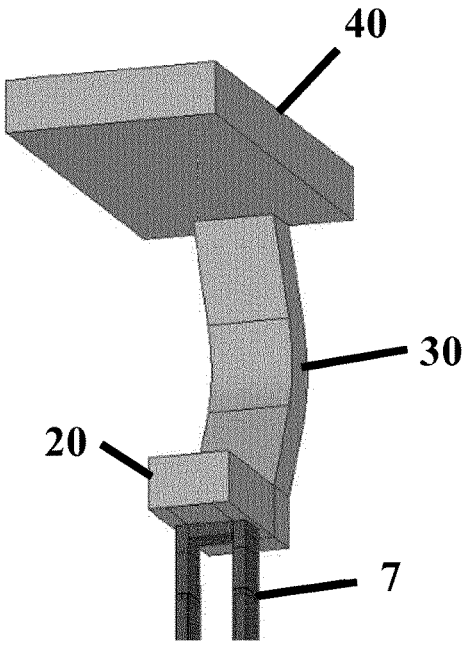
FIGS. 9A and 9B illustrate a test set up for comparing the effects of a collector bar without a zone of reduced cross-section to one with a zone of reduced cross-section.
Figure 9B:
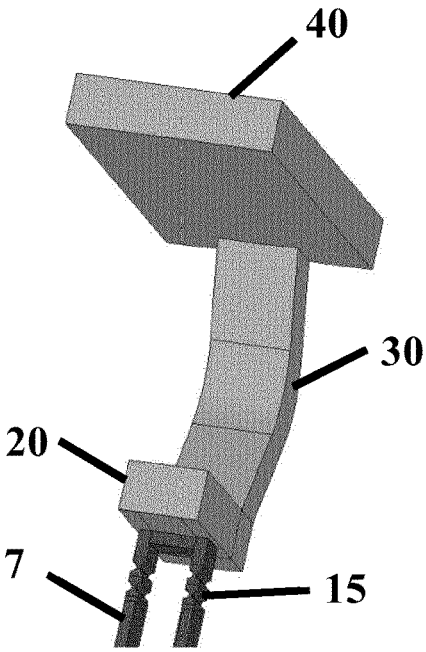

The reduction of external voltage can be significant:

FIGS. 9A and 9B illustrate a test set up for comparing the effects of a collector bar without a zone of reduced cross-section to one with a zone of reduced cross-section.

As shown in FIG. 9A, a collector bar 7 without a zone of reduced cross-section is connected to an aluminium block 20 which is in turn connected to an external bus 40 by a flexible copper connector 30. FIG. 9B shows a comparable set-up except that the collector bar 7 has a zone 15 of reduced cross-section, formed namely by opposite pairs of grooves in the opposite sides of the two arms making up the collector bar 7. The two set-ups were subjected to identical test conditions and the temperature of the bars measured. The temperature at the end of the collector bars, i.e. at the location of the terminal cross-piece was respectively 241° C. for the collector bar without a zone of reduced cross-section, and 218° C. for the collector bar with a zone of reduced cross-section.

The invention claimed is:

1. A cathode current collector and connector assembly assembled in a carbon cathode of a Hall-Heroult cell for the production of aluminium, said assembly comprising:

at least one collector bar of a copper or copper alloy that is located under the carbon cathode is in direct electrical contact with the carbon cathode, wherein the or each collector bar comprises one or two terminal end part or parts extending outwardly up to inside or outside a cell outer cover to a connector, whereat said terminal end part(s) of the or each collector bar are electrically connected in series each to a conductor element providing connection to an external bus, wherein said conductor element providing electrical connection of the collector bar to an external bus comprises a flexible connector strip which is made of copper or copper alloy.

2. The cathode current collector and connector assembly according to claim 1, wherein the flexible connector strip is a flexible strip having at its ends connecting pieces of solid copper with rings or hooks for connection directly or indirectly to the terminal part of the collector bar and to an external bus.

3. The cathode current collector and connector assembly according to claim 1, wherein said terminal part(s) of the collector bars comprise in the vicinity of said connector a zone of reduced cross-sectional area wherein the cross-sectional area of said zone of the terminal part is less than the cross-sectional area of the remainder of said terminal part(s).

4. The cathode current collector and connector assembly according to claim 3, wherein the zone of reduced cross-sectional area comprises at least one opening, or recess or part of reduced thickness in the terminal end part of the collector bar.

5. The cathode current collector and connector assembly according to claim 1, wherein said connector comprises a conductor block of the same copper or copper alloy as the collector bar, a different electrically conductive metal or a different copper alloy from the collector bar, and wherein the conductor block is attached to the terminal end part of the collector bar(s) such that it protrudes from above and below and/or laterally from either side of said terminal end part.

6. The cathode current collector and connector assembly according to claim 5, wherein the collector bar comprises two spaced-apart arms joined at an external end by a cross-piece, wherein the conductor block is externally connected to the cross-piece, and wherein the two spaced-apart arms each comprise adjacent to the connection with the cross-piece, a said zone wherein the cross-sectional area of each arm is less than the cross-sectional area of the remainder of said arms.

7. The cathode current collector and connector assembly according to claim 5, wherein the conductor block is connected to the flexible connector strip which is made of a plurality of strips or braids or embossed sections of highly conductive metal and wherein the conductor block is made of aluminium, copper or alloys thereof.

8. The cathode current collector and connector assembly according to claim 5, comprising a bimetallic plate between facing surfaces of the conductor block and the collector bar.

9. The cathode current collector and connector assembly according to claim 1, wherein said terminal part(s) of the collector bars comprise an outer protective casing of metal extending up to the vicinity of said connector.

10. The cathode current collector and connector assembly according to claim 9, wherein the space between the collector bar and the protective casing is optionally filled with a compressible material of low electrical conductivity and low thermal conductivity.

11. The cathode current collector and connector assembly according to claim 1, wherein at least one cathode is composed of carbon and/or graphite in a proportion of at least 50% by weight of carbon.

12. The cathode current collector and connector assembly according to claim 1, wherein an upper part of the cathode contains at least one refractory hard metal compound like TiB2 and a lower part of the cathode is made of carbon.

13. A Hall-Heroult cell for the production of aluminium fitted with a cathode current collector and connector assembly according to claim 1.

* * * * *